US007725982B2

(12) United States Patent
Hoch

(10) Patent No.: US 7,725,982 B2
(45) Date of Patent: Jun. 1, 2010

(54) HINGED CORNER TROWEL

(76) Inventor: Stephen C. Hoch, 13320 Mortons Corners Rd., Springville, NY (US) 14141-9721

( * ) Notice: Subject to any disclaimer, the term of this patent is extended or adjusted under 35 U.S.C. 154(b) by 0 days.

(21) Appl. No.: 12/244,890

(22) Filed: Oct. 3, 2008

(65) Prior Publication Data

US 2009/0089953 A1 Apr. 9, 2009

Related U.S. Application Data

(60) Provisional application No. 60/977,676, filed on Oct. 5, 2007.

(51) Int. Cl.
*B05C 17/10* (2006.01)

(52) U.S. Cl. ..... 15/235.7; 15/235.8

(58) Field of Classification Search ..... 15/235.7, 15/235.8

See application file for complete search history.

(56) References Cited

U.S. PATENT DOCUMENTS

| | | | | |
|---|---|---|---|---|
| 109,073 A | | 11/1870 | Streeter | |
| 1,370,060 A | | 3/1921 | Smith | |
| 4,757,572 A | * | 7/1988 | Yon | 15/235.7 |
| 5,192,558 A | | 3/1993 | Sparrow et al. | |
| 5,263,836 A | | 11/1993 | Tinawong | |
| 5,442,832 A | | 8/1995 | Tonsager | |
| 5,467,497 A | | 11/1995 | Greene et al. | |
| 5,544,384 A | | 8/1996 | Forselius et al. | |
| 5,664,280 A | * | 9/1997 | Tonsager | 15/235.7 |
| 5,699,580 A | * | 12/1997 | Silverstein | 15/235.7 |
| 5,774,924 A | | 7/1998 | Beckham et al. | |
| 5,792,489 A | | 8/1998 | Liberman | |
| 7,246,402 B2 | * | 7/2007 | Washburn | 15/235.7 |
| 2006/0185110 A1 | * | 8/2006 | Washburn | 15/235.7 |
| 2009/0083928 A1 | * | 4/2009 | Salvino | 15/235.7 |

* cited by examiner

*Primary Examiner*—Randall Chin
(74) *Attorney, Agent, or Firm*—Hodgson Russ LLP

(57) ABSTRACT

An adjustable hinged corner trowel is formed from hinged plates with a removeably attached handle. Cooperating control arms connect the handle to the hinged plates. The control arms are fixed to the hinged plates and can be fixed relative to each other at the handle by cooperating teeth and grooves. The handle has a threaded member capable of receiving a wing nut to fix the control arms against each other. Thereby, the angle of the hinged plates may be adjusted. The hinged corner trowel establishes both sides of any angled corner at the same time for utilization on drywall or similar materials.

7 Claims, 9 Drawing Sheets

HINGED CORNER TROWEL

CROSS-REFERENCE TO RELATED APPLICATIONS

This application claims priority benefit of U.S. Provisional Patent Application No. 60/977,676, filed Oct. 5, 2007, the disclosure of which is incorporated herein by reference.

FIELD OF THE INVENTION

The present invention relates to adjustable trowels, and more specifically to adjustable trowels used for applying and smoothing material on drywall or similar materials and having hinged plates for adjusting to a variety of angles.

BACKGROUND OF THE INVENTION

Various hand tools exist for applying, smoothing and leathering out joint compound during the construction of building spaces using so called dry wall or gypsum board panels. Where the joint to be finished is between two panels lying in the same plane, a planar trowel is commonly used. The planar trowel generally comprises a single thin steel rectangular sheet having a handle affixed thereto. Alternatively, a relatively wide putty knife may be used. Where two sheets of dry wall meet at a right angle, there is also available a trowel comprising a single thin sheet metal member that is bent along a midline to define two planar surfaces meeting at a fixed 90 degree angle. Again, a handle is affixed to the sheet metal member to facilitate positioning of the trowel in a corner joint and drawing it along the joint as joint compound is applied.

In many instances, dry wall panels are not oriented only at 180 degrees and at 90 degrees relative to one another, making it necessary for a tradesman to carry several trowels for accommodating a wide variety of angles. What is needed is an improved design for an adjustable hinged corner trowel.

SUMMARY OF THE INVENTION

The present invention meets the above-described need by providing an adjustable hinged corner trowel formed from hinged plates with a removeably attached handle. Cooperating control arms connect the handle to the hinged plates. The cooperating arms are preferably constructed of wire and may have teeth and grooves capable of engagement for adjusting and locking the hinged plates into various positions.

The control arms are fixed to the hinged plates and can be fixed relative to each other at the handle by cooperating teeth and grooves. The handle has a threaded member capable of receiving a wing nut to fix the control arms against each other. Thereby, the angle of the hinged plates may be adjusted. The hinged corner trowel establishes both sides of any angled corner at the same time for utilization on drywall or similar materials.

BRIEF DESCRIPTION OF THE DRAWINGS

The invention is illustrated in the drawings in which like reference characters designate the same or similar parts throughout the figures of which.

DETAILED DESCRIPTION

Figure 1:
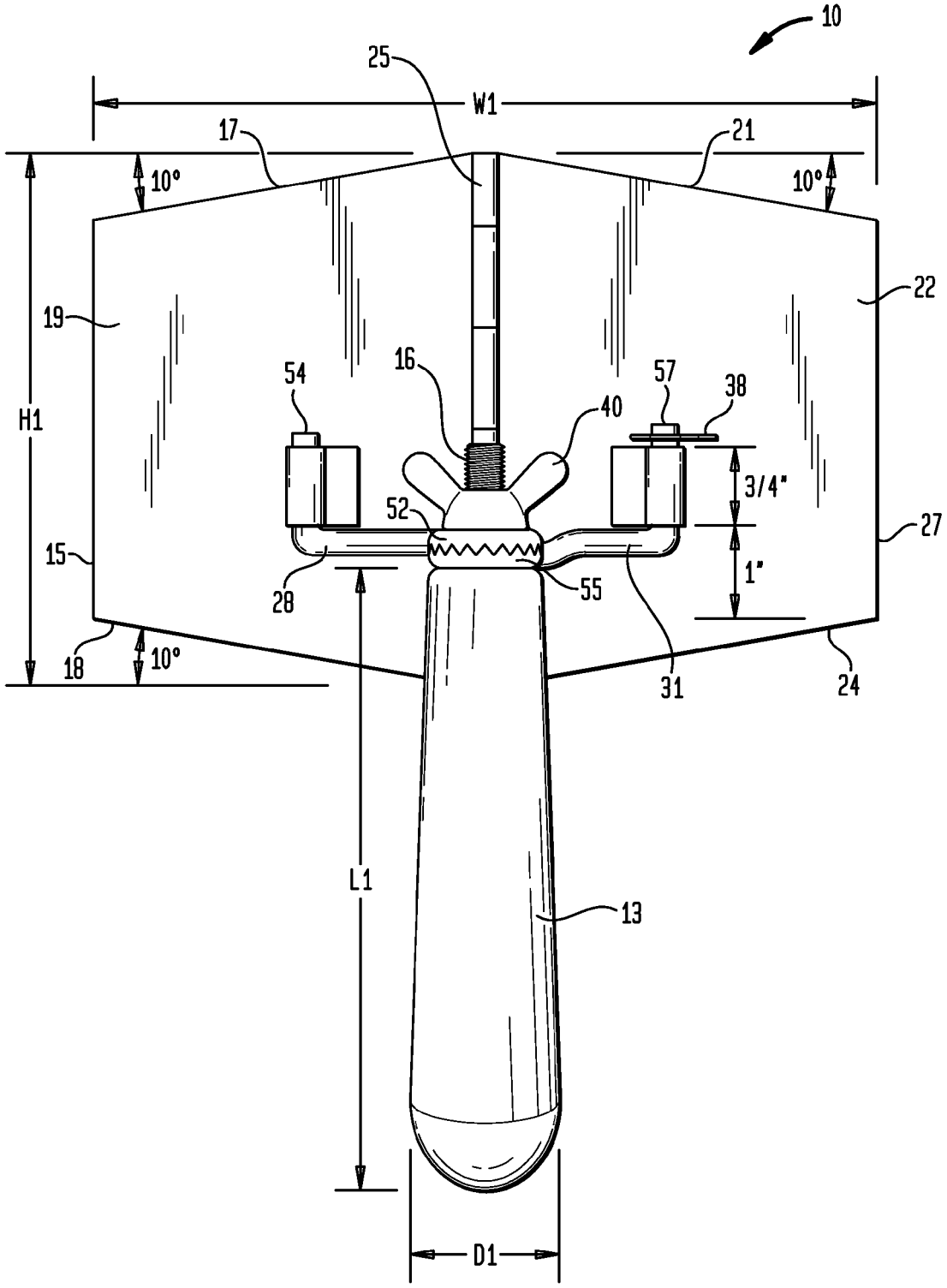
FIG. 1 is a rear elevational view of a hinged corner trowel of the present invention.

FIGS. 1-6 show a hinged corner trowel 10 in accordance with a first embodiment of the invention. A hinged corner trowel 10 may have a handle 13 with a threaded post 16 disposed thereon. FIG. 1 shows that the handle 13 may have a length L1 of approximately 6 inches and a diameter D1 of approximately 1¼ inches. Other dimensions may also be used as will be evident to those of ordinary skill in the art. The handle 13 may be disposed between a pair of flat plates 19, 22 which may be connected to each other at a hinge 25. Plate 19 may include top edge 17 and bottom edge 18, and plate 22 may include top edge 21 and bottom edge 24. The plates 19, 22 may be constructed of a 25 gauge steel, or other suitable material. The plates 19, 22 may have an overall width W1 of approximately 8 inches and a height H1 at the hinge 25 of approximately 5½ inches. The top and bottom edges 17, 18, 21, 24 of plates 19 and 22 may have a taper from the hinge 25 to their outer edges 15, 27, respectively. In a preferred embodiment of the invention, the taper may be approximately 10 degrees from the hinge 25 to the outer edges 15, 27. Other dimensions may also be used for the plates which may provide adequate surface area for the application of joint compound or other material, as will be evident to those of ordinary skill in the art.

Figure 3:
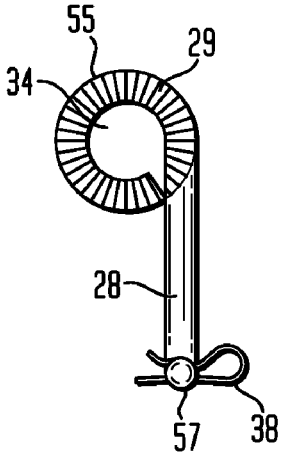
FIG. 3 is top plan view of one of the arms of the hinged corner trowel.
Figure 4:
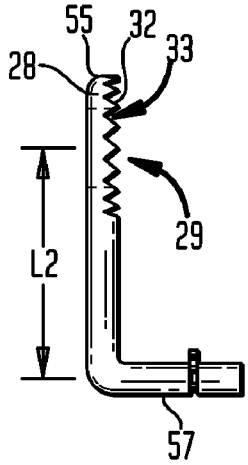
FIG. 4 is a side elevational view of the arm shown in FIG. 3.

The handle 13 may be connected to the hinged plates 19, 22 by a pair of arms 28, 31. The arms 28, 31 have first and second opposed ends 52, 54 and 55, 57, respectively. According to a first embodiment of the invention, the arms 28, 31 may be constructed from any suitable rigid material, but are preferably constructed from wire. The wire may be constructed from steel or other suitable materials and may have a diameter of 3/16 inches. FIGS. 3 and 4 show one of the arms 31 according to the first embodiment of the invention. The arm 31 may have an opening 34 located at a first end 55. Preferably, the opening 34 may be approximately 5/16 inches in order to be able to receiving the post 16. However, openings of other sizes may be suitable. The arm 31 may have a length L2 of approximately 2¼ inches from the second end 57 to the center of the opening 34. FIG. 3 shows that arm 31 may be provided with a surface 29 comprising a series of alternating V-shaped teeth 32 and grooves 33 located at the first end 55. Arm 28 may also be constructed in a similar manner to arm 31 and may have similar features. According to the first embodiment of the invention, each arm 28, 31 may have 30 teeth defining V-shaped grooves, having a 45 degree angle, in surface 29. The teeth 32 of one of the arms 28, 31 are capable of engaging with the grooves 33 on the opposite arm 28, 31. The teeth and grooved surfaces may be stamped or machined onto the wire. The teeth and grooves may have other suitable arrangements and may also be formed in other ways as will be evident to those of ordinary skill in the art.

FIG. 1 shows that the arms 28, 31 may be arranged on the post 16 via openings 34 in the first ends 52, 55 of the arms 28, 31. The post 16 may include standard threading as known to those of ordinary skill in the art. The arms 28, 31 may be seated such that the surfaces 29 having the teeth 32 and grooves 33 on the respective arms 28, 31 are facing each other. In use, when the teeth 32 of the arm 28 are inserted into the grooves 33 on the arm 31, the position of the arms 28, 31 may be fixed relative to each other and the arms are not capable of angular movement relative to one another. When the teeth 32 are removed from the grooves 33, the arms 28, 31 may be rotated relative to one another around the post 16.

Figure 6:
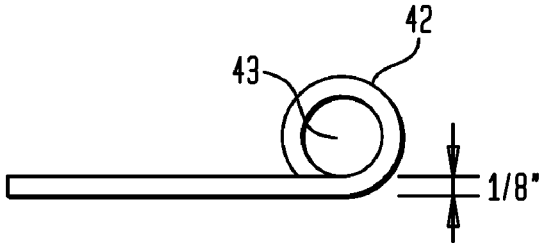
FIG. 6 is a partial top plan view of a hinge hoop of the present invention.

Many different arrangements may be used to attach the second ends 54, 57 of arms 28, 31 to the plates 19, 22. FIG. 6 shows a hinge hoop 42 which may be spot welded to plate 19, 22. The hinge hoop 42 may be approximately ¾ inch in length and may have an opening 43 approximately 3/16 inch in diameter, running along its length, in order to receive the second ends 54, 57 of arms 28, 31. FIGS. 1 and 3 show a clip 38 which may be engaged with the second ends 54, 55 of the arms 28, 31 after insertion through the hinge hoop 42 in order to secure the arms 28, 31 to the plates 19, 22. The clip 38 may be removed to detach the arms 28, 31 from the plates 19, 22. The second ends 54, 55 of the arms 28, 31 may be removeably attached to the plates 19, 22 in other ways as will be evident to those of ordinary skill in the art. Alternatively, the arms 28, 31 may be permanently attached to the plates 19, 22.

Figure 2:
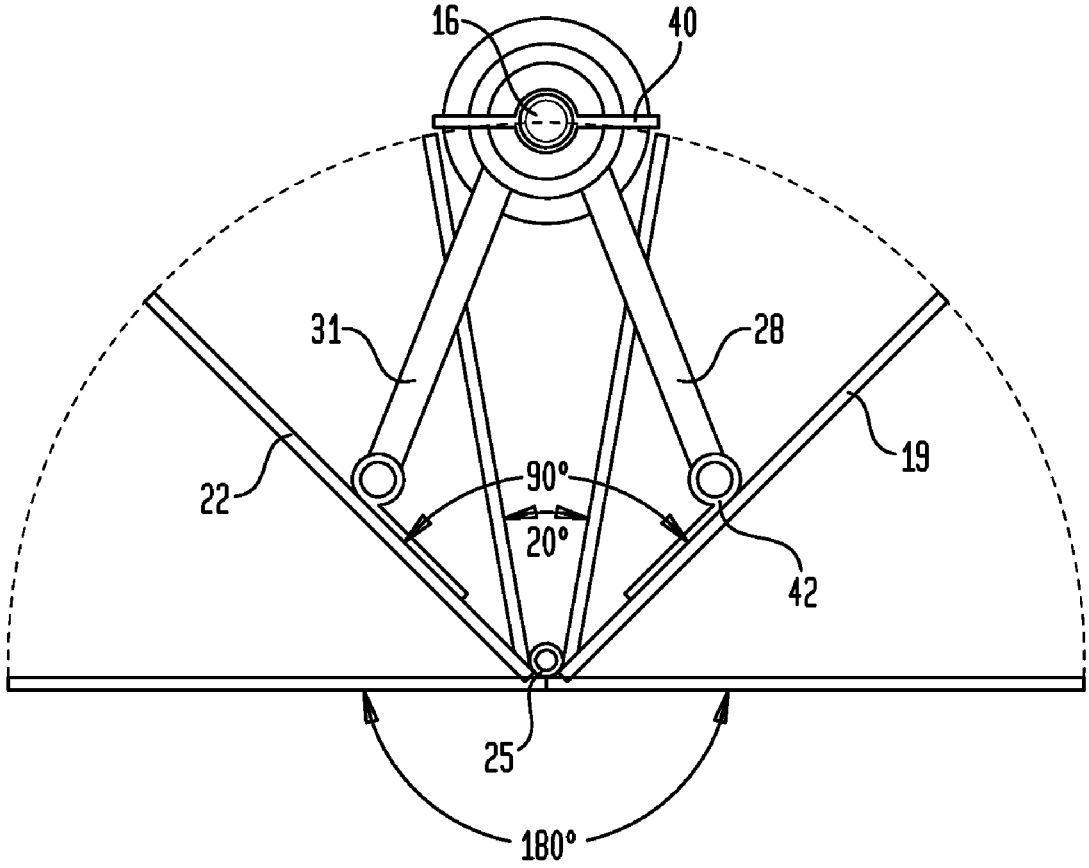
FIG. 2 is a top plan view of the hinged corner trowel.
Figure 5:
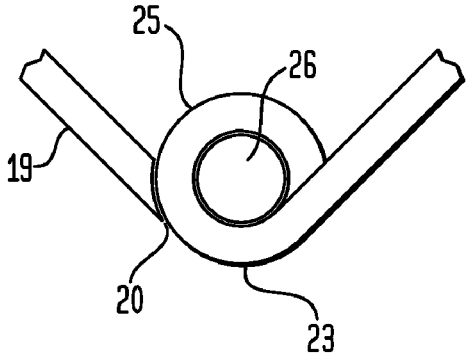
FIG. 5 is a partial top plan view of the hinge of the present invention.

FIG. 5 shows the hinge 25 which connects the plates 19, 22 together. The hinge 25 may be of ordinary construction. For example, the plates 19, 22 may be connected by a hinge pin 26 which may be a 1/16 inch steel wire. In order to ensure a tight seam between the plates 19, 22, the abutting edges 20, 23, respectively, may be formed with 45 degree angles, as will be evident to those of ordinary skill in the art. FIG. 2 shows that the hinge 25 may enable the user to vary the angle between the plates 19, 22 from between an acute angle of approximately 20 degrees through an obtuse angle of 180 degrees, in this example.

Returning to FIG. 1, shown is a wing nut 40 which may be used on the threaded post 16 to lock the arms 28, 31 into engagement with each other. The wing nut 40 may be a standard wing nut known in the art. In use, when the wing nut 40 is tightened down onto the post 16, it pushes the top arm 28 against the bottom arm 31 causing the teeth and grooves to engage. When the user wants to adjust the angle of the plates 19, 22, the wing nut 40 may be loosened and the arms 28, 31 may be rotated relative to one another.

FIGS. 7-9C show a hinged corner trowel 110 in accordance with a second embodiment of the invention. The hinged corner trowel 110 may have a handle 113 with a threaded post 116 disposed thereon. The handle 113 may be disposed between a pair of flat plates 119, 122 which may be connected to each other at a hinge 125. Plate 119 may include top edge 117 and bottom edge 118, and plate 122 may include top edge 121 and bottom edge 124. The plates 119, 122 may be constructed of a 25 gauge steel, or other suitable material. The plates 119, 122 may have an overall width W2 of approximately 8 inches and a height H2 at the hinge 125 of approximately 5 inches. The top and bottom edges 117, 118, 121, 124 of plates 119 and 122 may have a taper from the hinge 125 to their outer edges 115, 127, respectively of approximately 5 degrees. Other dimensions may also be used for the plates which may provide adequate surface area for the application of joint compound or other material, as will be evident to those of ordinary skill in the art.

The handle 113 may be connected to the hinged plates 119, 122 by a pair of arms 128, 131. The arms 128, 131 have first and second opposed ends 152, 154 and 155, 157, respectively. In this embodiment of the invention, the arms 128, 131 may be arranged with arm 128 abutted against the handle 113 and arm 131 abutted against a wing nut 140.

Figure 8:
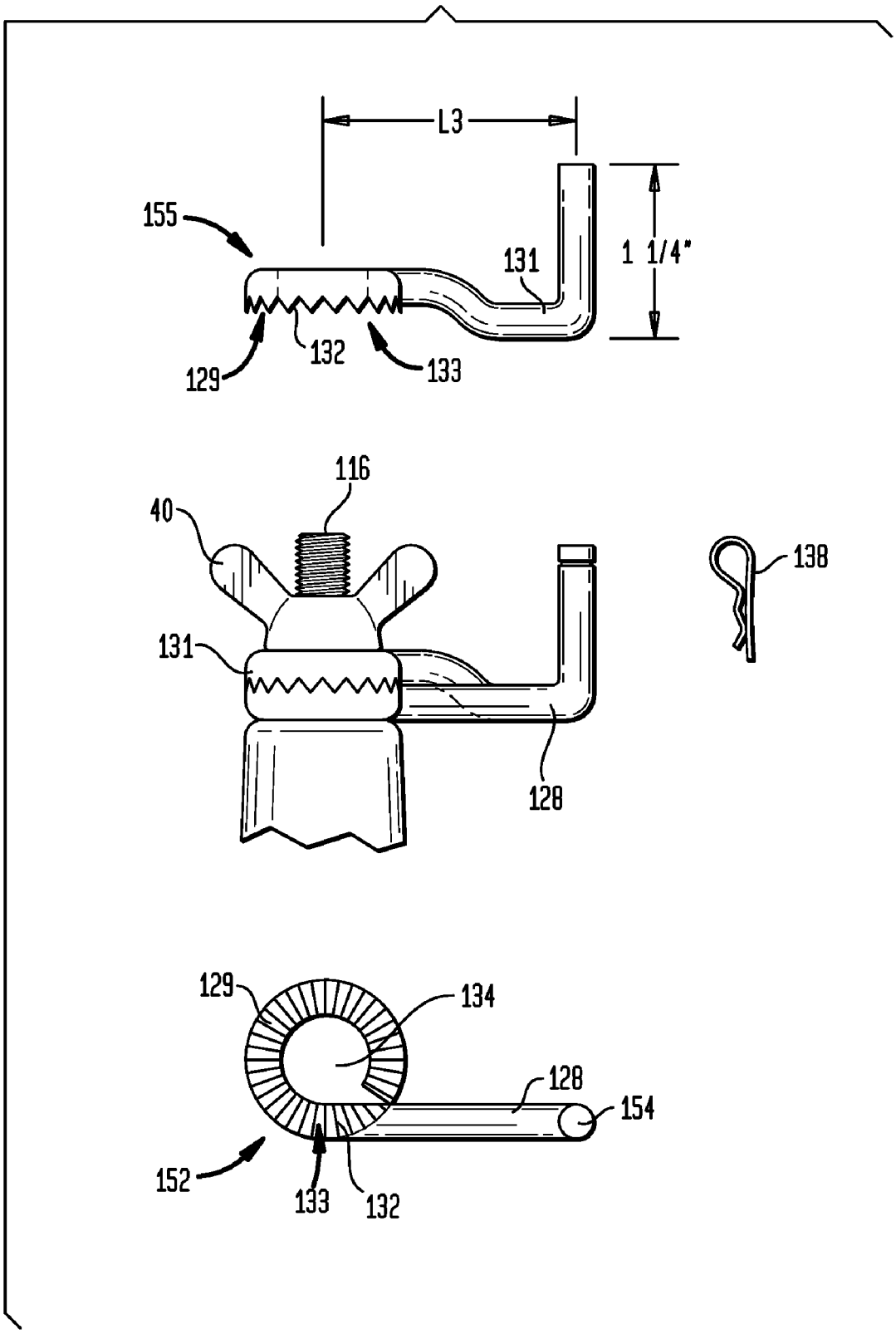
FIG. 8 is a view of the arms of the second embodiment of the present invention shown seated on the post, and shown in a partial exploded view.

FIG. 8 shows arms 128 and 131 according to the second embodiment of the invention. The arms 128, 131 may have an opening 134 located at a first ends 152, 155 for receiving the post 116. The arms 128, 131 may each be provided with a surface 129 comprising a series of alternating V-shaped teeth 132 and grooves 133 located at a first ends 152, 155. The arms 128, 131 may each have forty teeth forming 45 degree angle V-shaped grooves in surfaces 129. The teeth 132 of one of the arms 128, 131 are capable of engaging with the grooves 133 on the opposite arm 128, 131. The arms 128, 131 may have a length L3 of approximately 1½ inches from their second ends 154, 157 to the center of the openings 134.

Figure 7:
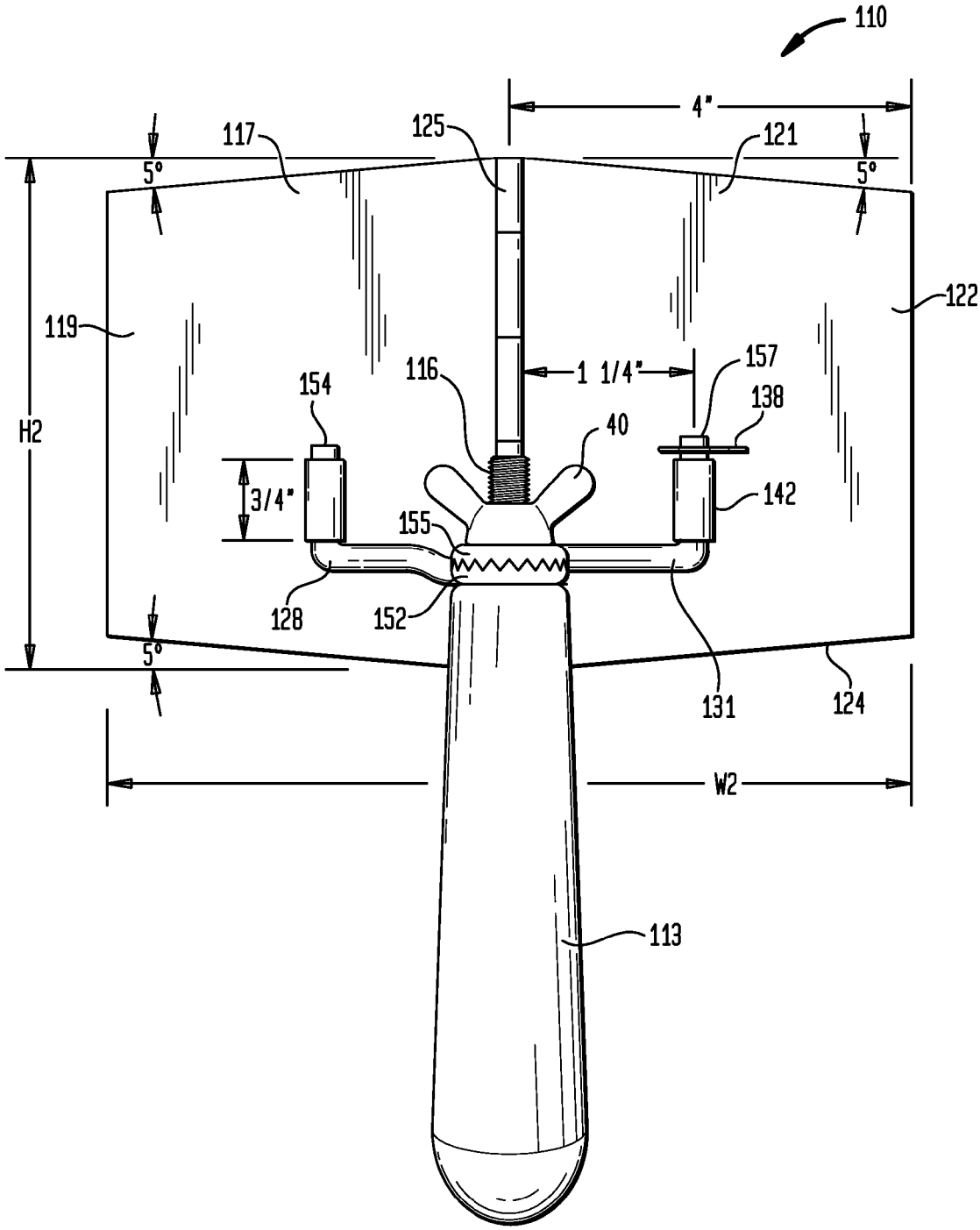
FIG. 7 is a rear elevational view of a hinged corner trowel according to a second embodiment of the present invention.

FIG. 7 shows that the arms 128, 131 may be arranged on the post 116 via openings 134 in the first ends 152, 155 of the arms 128, 131. The arms 128, 131 may be seated such that the surfaces 129 having the teeth 132 and grooves 133 on the respective arms 128, 131 are facing each other. In use, when the teeth 132 of the arm 128 are inserted into the grooves 133 on the arm 131, the position of the arms 128, 131 may be fixed relative to each other and the arms are not capable of angular movement relative to one another. When the teeth 132 are removed from the grooves 133, the arms 128, 131 may be rotated relative to one another around the post 116.

Figure 9A:
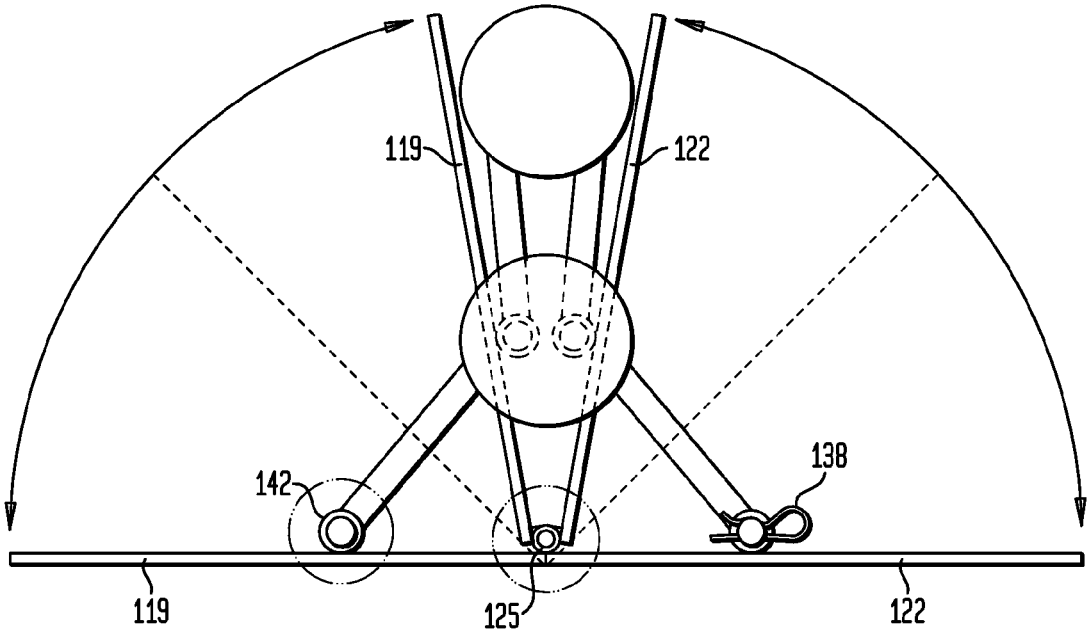
FIG. 9A is a bottom plan view of the hinged corner trowel of the second embodiment of the present invention.
Figure 9B:
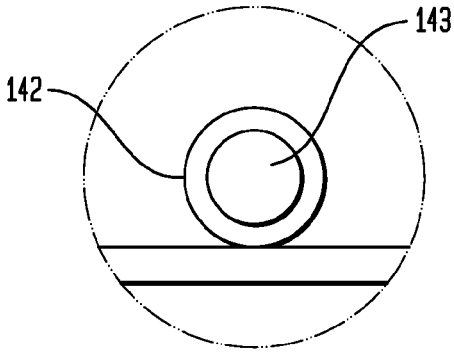
FIG. 9B is a partial top plan view of a hinge hoop of the second embodiment of the invention.

Many different arrangements may be used to attach the second ends 154, 157 of arms 128, 131 to the plates 119, 122. FIG. 9B shows a hinge hoop 142 which may be spot welded to plate 119, 122. FIG. 7 shows that the hinge hoop 142 may be approximately ¾ inch in length. The hinge hoop 142 may have an opening 143 approximately 3/16 inch in diameter, running along its length, in order to receive the second ends 154, 157 of arms 128, 131. The hinge hoop 142 may be welded to the plates 119, 122 approximately 1¼ inches from the hinge 125, measuring to the center of the opening 143. The second ends 154, 157 of arms 128, 131 may be approximately 1¼ inches long in order to protrude from the end of the hinge hoop 142. FIGS. 8 and 9A show a clip 138 which may be engaged with the second ends 154, 155 of the arms 128, 131 after insertion through the hinge hoop 142 in order to secure the arms 128, 131 to the plates 119, 122. The clip 138 may be removed to detach the arms 128, 131 from the plates 119, 122. The second ends 154, 155 of the arms 128, 131 may be removeably attached to the plates 119, 122 in other ways as will be evident to those of ordinary skill in the art. Alternatively, the arms 128, 131 may be permanently attached to the plates 119, 122.

Figure 9C:
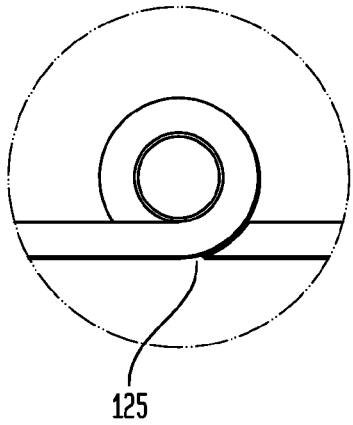
FIG. 9C is a partial top plan view of the hinge of the second embodiment of the invention.

FIG. 9C shows the hinge 125 which connects the plates 119, 122 together. FIG. 9A shows that the hinge 125 may enable the user to vary the angle between the plates 119, 122 from between an acute angle of approximately 20 degrees through an obtuse angle of 180 degrees, in this example.

Returning to FIG. 7, shown is a wing nut 140 which may be used on the threaded post 116 to lock the arms 128, 131 into engagement with each other. In use, when the wing nut 140 is tightened down onto the post 116, it pushes the top arm 131 against the bottom arm 128 causing the teeth and grooves to engage. When the user wants to adjust the angle of the plates 119, 122, the wing nut 140 may be loosened and the arms 128, 131 may be rotated relative to one another.

FIGS. 10-13B show a hinged corner trowel 210 in accordance with a third embodiment of the invention. The hinged corner trowel 210 may have a handle 213 with a threaded post 216 disposed thereon. The handle 213 may be disposed between a pair of flat plates 219, 222 which may be connected to each other at a hinge 225. Plate 219 may include top edge 217 and bottom edge 218, and plate 222 may include top edge 221 and bottom edge 224. The plates 219, 222 may be constructed of a 26 gauge steel, or other suitable material. The plates 219, 222 may have an overall width W3 of approximately 8½ inches and a height H3 at the hinge 225 of approximately 5 inches. The top and bottom edges 217, 218, 221, 224 of plates 219 and 222 may be tapered from the hinge 225 to the outer edges 215, 227, respectively so that the outer edges 215, 227 have a height H4 of approximately 3 11/16 inches. Other dimensions may also be used for the plates which may provide adequate surface area for the application of joint compound or other material, as will be evident to those of ordinary skill in the art.

Figure 10:
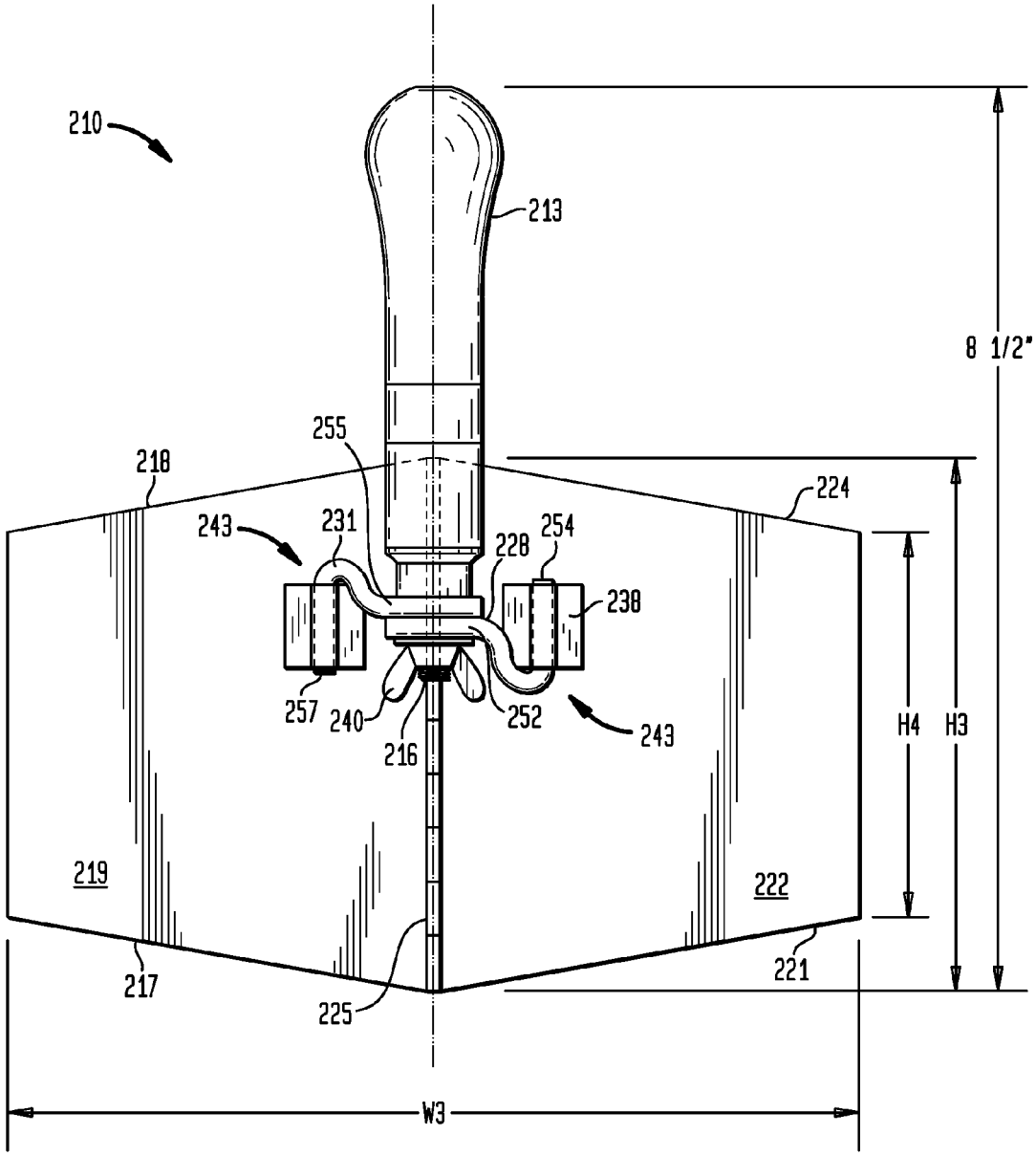
FIG. 10 is a rear elevational view of a hinged corner trowel in accordance with a third embodiment of the present invention.

The handle 213 may be connected to the hinged plates 219, 222 by a pair of arms 228, 231. The arms 228, 231 have first and second opposed ends 252, 254 and 255, 257, respectively. In this embodiment of the invention, the arms 228, 231 may be arranged with arm 231 abutted against the handle 213 and arm 228 abutted against a wing nut 240. FIG. 10 shows that the second ends 254, 257 of the arms 228, 231, respectively, may be arranged on the plates 219, 222 so as to point in opposing directions.

Figure 12:
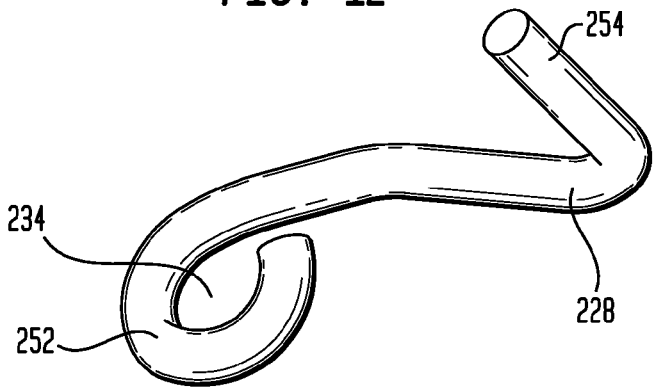
FIG. 12 is a perspective view of an arm of the third embodiment of the present invention.

FIG. 12 shows arm 228 according to the third embodiment of the invention. The arm 228 may have an opening 234 located at a first end 252 for receiving the post 216. Arm 231 may also be constructed in a similar manner to arm 228 and may have similar features. The arms 228, 231 may be arranged on the post 216 via openings 234 in the first ends 252, 255 of the arms 228, 231. In use, the position of the arms 228, 231 may be fixed relative to each other by application of pressure via tightening the wing nut 240 whereby the arms are not capable of angular movement relative to one another. When the wing nut 240 is loosened or removed, the arms 228, 231 may be rotated relative to one another around the post 216.

Many different arrangements may be used to attach the second ends 254, 257 of arms 228, 231 to the plates 219, 222. FIG. 10 shows hinge hoops 242 which may be spot welded to plates 219, 222. The hinge hoops 242 may have openings 243 running along their length, in order to receive the second ends 254, 257 of arms 228, 231. The second ends 254, 257 of arms 228, 231 may be friction fit through the openings 243 in the hinge hoops 242.

Figure 11A:
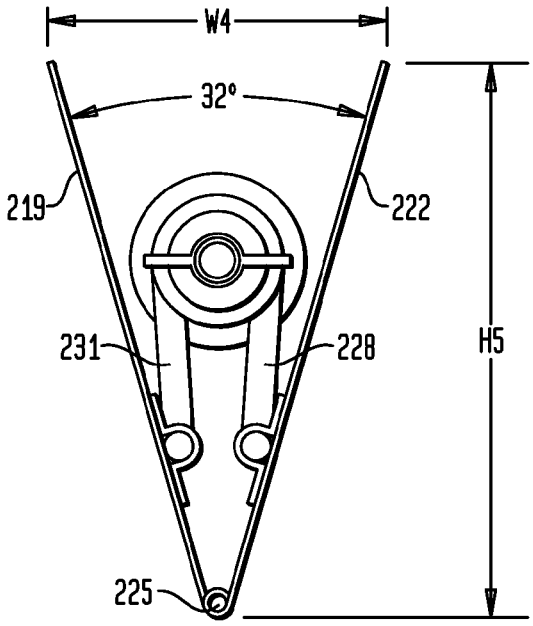
FIG. 11A is a bottom plan view of the hinged corner trowel of the third embodiment of the present invention.
Figure 11B:
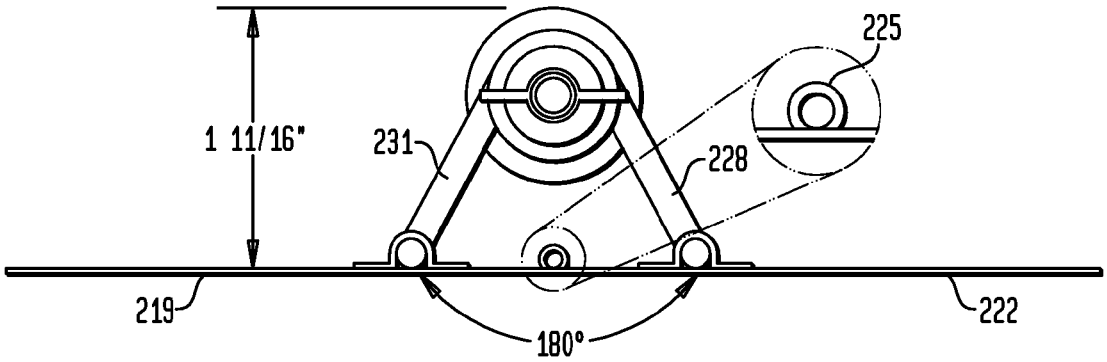
FIG. 11B is a bottom plan view of the hinged corner trowel of the third embodiment of the present invention with the plates shown in an alternate position.

FIG. 11B shows the hinge 225 which connects the plates 219, 222 together. FIG. 11A shows that the hinge 225 may enable a user to vary the angle between the plates 219, 222 from between an acute angle of approximately 30 degrees through an obtuse angle of 180 degrees. FIG. 11A shows a positioning of the plates 219, 222 where the angle between the plates is 32 degrees. In this state, the overall height H5 of the hinged corner trowel 210 may be approximately 3 15/16 inches, and the overall width W4 may be approximately 2 5/16 inches. FIG. 11B shows an alternate positioning of the plates 219, 222 where the angle between the plates is 180 degrees. In this state, the overall height H6 of the hinged corner trowel 210 may be approximately 1 11/16 inches.

Figure 13A:
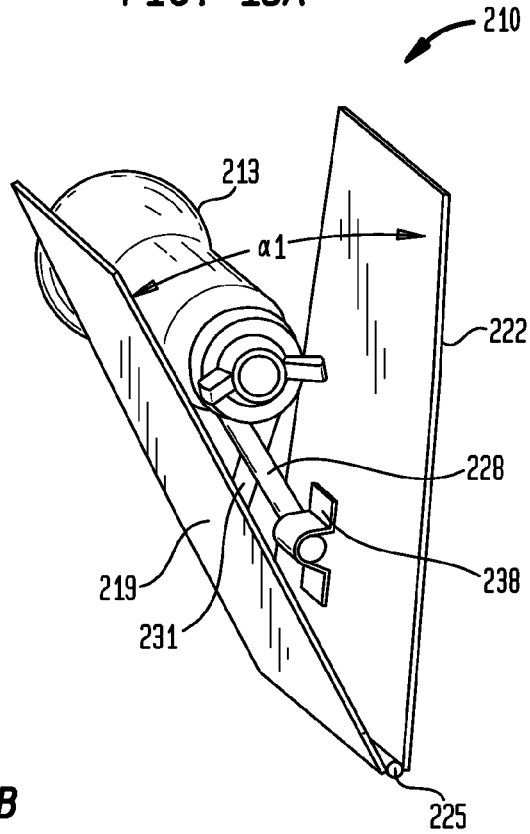
FIG. 13A is a perspective view of the hinged corner trowel of the third embodiment of the invention.
Figure 13B:
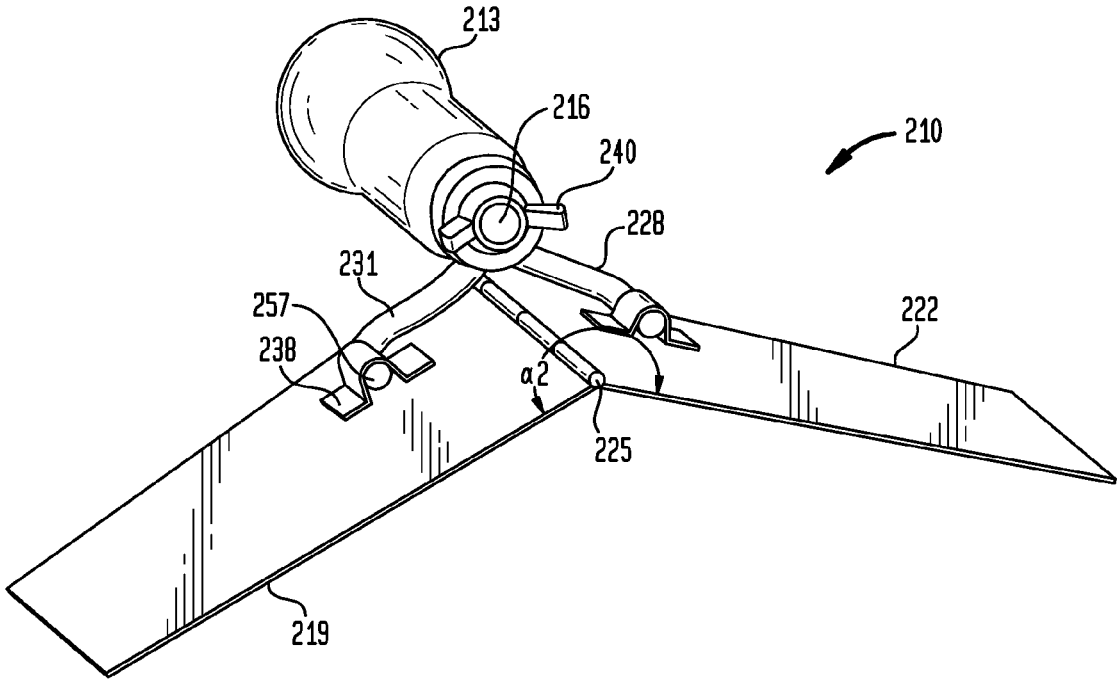
FIG. 13B is a perspective view of the hinged corner trowel of the third embodiment of the invention with the plates shown in an alternate position.

FIG. 13A shows the hinged corner trowel 210 according to the third embodiment of the invention. In this example, it is shown how the hinged corner trowel 210 may be used with the plates 219, 222 lying at an acute angle $\alpha$1. FIG. 13B shows how the hinged corner trowel 210 may be used with the plates 219, 222 lying at a reflex angle $\alpha$2.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention.

What is claimed is:

1. An adjustable trowel, comprising;

first and second planar plates;

a hinge connecting the first and second plates to each other;

a handle connected to the first and second plates, the handle having a post thereon; and a pair of control arms for selectively adjusting a position of the first and second plates relative to each other, the control arms having openings for receiving the post and having teeth defined thereon for engaging with the teeth on the other control arm to fix the position of the plates relative to one another.

2. The adjustable trowel of claim 1, wherein the first and second plates are rectangular in shape.

3. The adjustable trowel of claim 1, wherein the first and second plates are trapezoidal in shape.

4. The adjustable trowel of claim 1, further comprising a wing nut for releasably locking the first and second plates at a desired angle relative to each other.

5. The adjustable trowel of claim 4, wherein the desired angle is an acute angle.

6. The adjustable trowel of claim 4, wherein the desired angle is an obtuse angle.

7. The adjustable trowel of claim 4, wherein the desired angle is a reflex angle.

* * * * *